United States Patent [19]

Avidan

[11] Patent Number: 4,927,348

[45] Date of Patent: May 22, 1990

[54] CIRCULATING FLUID BED COMBUSTION WITH CO COMBUSTION PROMOTER AND REDUCED COMBUSTION AIR

[75] Inventor: Amos A. Avidan, Yardley, Pa.

[73] Assignee: Mobil Oil Corporation, New York, N.Y.

[21] Appl. No.: 270,929

[22] Filed: Nov. 14, 1988

[51] Int. Cl.[5] ..... F23D 3/40

[52] U.S. Cl. ..... 431/7; 110/345; 110/347

[58] Field of Search ..... 431/3, 4, 7; 110/342, 110/344, 345, 347

[56] References Cited

U.S. PATENT DOCUMENTS 4,388,877 6/1983 Molayem et al. ..... 110/342

4,515,092 5/1985 Walsh et al. ..... 110/342

4,579,070 4/1986 Yung-Yi Lin et al. ..... 110/345

4,735,705 4/1988 Burk et al. ..... 110/345

*Primary Examiner*—Carroll B. Dority

*Attorney, Agent, or Firm*—A. J. McKillop; C. J. Speciale; R. D. Stone

[57] ABSTRACT

Addition of a CO combustion promoter to a circulating fluid bed (CFB) combustion unit and reduction of the air addition rate to 100–110% of stoichiometric improves the efficiency of CO burning, reduces emissions of CO and improves the efficiency of the unit. Stable, reduced temperature operation with air rates close to stoichiometric, reduces $NO_x$ emissions. A circulating (100–400 micron particles) or fast settling (400–1200 micron particle) CO combustion promoter may be used.

15 Claims, 3 Drawing Sheets

CIRCULATING FLUID BED COMBUSTION WITH CO COMBUSTION PROMOTER AND REDUCED COMBUSTION AIR

FIELD OF THE INVENTION

This invention relates to circulating fluid bed combustors.

BACKGROUND

Fluidized bed combustion is a mature technology. Many fluidized bed processes where combustion occurs are known, including the regenerators associated with fluidized catalytic cracking (FCC) units, fluidized coal combustors, and "regenerators" associated with fluid cokers.

Many fluidized bed combustion processes achieve only partial combustion of carbon (in coke, hydrocarbon or coal) to $CO_2$. Partial combustion, to CO, represents a loss of energy and a source of air pollution.

In FCC regenerators, it is known to add a CO combustion promoter, such as PT, to the circulating catalyst inventory. Adding 0.1–10, usually 0.5–2 wt ppm Pt is common in FCC processes to achieve complete CO combustion. The Pt makes the regenerator run hotter, because of the more complete CO combustion. More air is added per unit weight of carbon burned, because more $CO_2$ is formed at the expense of CO. Although CO emissions are much reduced, there is an increase in $NO_x$ emissions, probably because of the more oxidizing atmosphere.

The Pt promoter lasts a long time in commercial FCC units, having an activity or catalyst life similar to that of the conventional FCC catalyst, which remains in the unit for months.

Similar results are noted in the Thermofor Catalytic Cracking (TCC) Process which is a moving bed analog to the FCC process.

Both FCC and TCC processes involve fairly clean feeds (heavy hydrocarbons) and stable, long lasting catalysts which are an ideal support for CO combustion promoters such as Pt.

Use of CO combustion promoters has been recommended for fluidized bed coke combustion. In U.S. Pat. No. 4,515,092 (Walsh et al), which is incorporated herein by reference, and in a related publication by Walsh et al entitled "A Laboratory Study of Petroleum Coke Combustion: Kinetics and Catalytic Effects", addition of sand-containing 0.1 and 1.0 wt. % Pt, is reported to promote CO combustion in a single fluidized bed of coke operating at 505° C.

A recent development has been the commercialization of circulating fluid bed (CFB) boilers.

In CFB units, operation is complex. A fuel, usually a low grade fuel with a lot of sulfur and other contaminants, e.g. coal, is burned in a riser combustor. The flow regime is primarily that of a fast fluidized bed, i.e., there are no large "bubbles". Motive force for the fast fluidized bed is usually combustion air added at the base of the riser. There is usually an extremely large range of particle sizes in CFB units.

Combustion air is generally added to the base of the fast fluidized bed, and the resulting flue gas is discharged from the top of the fast fluidized bed, generally into a cyclone separator which covers most of the larger particles, typically 100 microns plus, while allowing finer materials (fly ash) to be discharged with the flue gas. Solids recovered by the cyclone are recycled into the fast fluidized bed.

Heat is removed from the CFB units in many places. CFB units take advantage of the extremely high heat transfer rates which are obtainable in fluidized beds, and provide for one or more areas of heat recovery from the fluidized bed. Most units have at least one relatively dense phase fluidized bed heat exchanger intermediate the cyclone separator solids discharge and the fast fluidized bed combustor.

Fluid flow in CFBs is complex because of the tremendous range in particle size of materials which must be handled by many CFBs. When coal is the feed to a CFB unit, the particle size distribution can range from submicron particles to particles of several inches in diameter.

Submicron to several micron particles present include fly ash, ground dolomite or limestone, and perhaps a few particles of ground coal.

Particles less than 100 microns in diameter usually have a short life in CFB units, because the low efficiency cyclones usually associated with such units must be able to let the fly ash out, while retaining essentially all of the 100+ micron material, which usually represents coal, or ground sulfur absorbing material such as dolomite.

The 100 micron–400 micron material in a CFB represents much of the circulating particulate inventory. Usually this material is the dolomite, limestone, and similar materials used as an $SO_x$ acceptor, and some portion of the low grade fuels such as coal. When clean, or at least low sulfur, fuels such as wood chips are burned the sulfur acceptor is not needed and sand, or some other inert is provided for fluidization.

The coal particles may range in size from several inches when first added to the fast fluidized bed to theoretically submicron particles produced by explosion or disintegration of large size particles of coal. The majority of the coal is in large particles, typically 300–1000 microns, which tend to remain in a lower portion of the CFB, by elutriation.

Many CFB units are designed to handle small amounts of agglomerated ash. At the temperatures at which CFBs operate (usually 1550°–1650° F.) there is much sintering of ash, which forms larger and larger particles. Many CFBs are designed to allow large ash agglomerates, typically in the order of 1000–2000 microns, to drop out of the bottom of the CFB unit or to be removed intermittantly.

The chemical reactions occurring during CFB operation are complex. Coke combustion, reactions of sulfur and nitrogen compounds with adsorbents, reactions of $NO_x$ with reducing gases (such as CO which may be present), etc., are representative reactions.

Despite the explosive growth in CFB technology (from no commercial units 1978 to about in operation or under construction 100 commercial units in 1988) I realized that the technology had some shortcomings. Particularly troublesome was the tendency of the units to all operate at the same exceedingly high temperature, which causes some metallurgical, operational and pollution problems. CFBs also operate with far more air than is required by stoichiometry.

Typical circulating fluidized bed designs are disclosed in U.S. Pat. No. 4,776,288 and U.S. Pat. No. 4,688,521, which are incorporated by reference.

Circulating fluid bed combustion systems operating with staged air injection, or staged firing, as disclosed in U.S. Pat. No. 4,462,341 or in a reducing mode circulating fluid bed combustion unit, such as disclosed in U.S. Pat. No. 4,579,070 will minimize somewhat $NO_x$ emissions. The contents of both of these patents are incorporated herein by reference.

Separation means used to remove recirculating solids from flue gas may comprise cyclones, or the gas and particle separation means disclosed in U.S. Pat. No. 4,442,797 which is incorporated herein by reference.

I reviewed the state of the art in circulating fluidized bed technology. Fortunately most of the work on circulating fluidized beds has been published in two volumes. The first was Circulating Fluidized Bed Technology, Proceedings of the First International Conference on Circulating Fluidized Beds, Halifax, Nova Scotia, Canada, November 18–20, 1985, edited by Prabir Basu, Pergamon Press (hereafter CFB I) and, more recently, by Circulating Fluidized Bed Technology II, Proceedings of the Second International Conference on Circulating Fluidized Beds, Compiegne, France, 14–18 March 1988, edited by Prabir Basu and Jean Francois Large, Pergamon Press (hereafter CFB II).

Other workers were aware of the problems remaining in use of CFB units, see e.g. Analysis of Circulating Fluidized Bed Combustion Technology and Scope For Future Development, Takehiko Furusawa and Tadaaki Shimizu, page 51, in CFB II. The authors focused on three areas.

1. Heat Recovery
2. Design of Cyclones and Carbon Burn-Up
3. $NO_x$ Emissions

I realized that the problems of better carbon burning, and reduced $NO_x/SO_x$ emissions were related. This relationship can best be understood by reviewing the problem of emissions from CFB boilers.

EMISSIONS FROM CFB BOILERS

CFB boilers are being commercialized rapidly due to many factors. The first is fuel flexibility—CFB boilers can handle a mixture of fuels, including those rich in ash and moisture and fuels which are difficult to burn in conventional boilers. Some fuels combusted in commercial CFB boilers include: coals, wood waste, bark, petroleum coke, oil and gas, lignite, brown coal, peat, coal washings' rejects and industrial and sewage sludges. High combustion efficiencies, often 99%, are achieved. Fuel handling and feeding is simple, heat release rates are high, turndown and load following is excellent and CFBs have demonstrated excellent commercial availability records.

Most importantly, it is in low emission levels where CFB boilers have excelled. Low particulate, $SO_x$ and $NO_x$ emissions have allowed new CFB boilers to be installed in areas where permitting of conventional boilers to handle low grade fuels would have been impossible. Some of these areas include Southern California, Japan and Europe. With increasing concern over air quality, acid rain and smog, CFB boilers offer an excellent alternative to utilities and industrial users. Their rate of commercialization is expected to continue at the fast rate of the past eight years.

The good contact between gas and solids in a CFB combustion affords excellent sulfur capture by circulating fine limestone. Ca/S ratios of 1–4 are used, and the resulting gypsum can be disposed of safely. Sulfur capture efficiencies of over 90% are possible. With combustion temperatures of 1550°–1650° F., and staged combustion (typically half of the air is introduced as secondary air), $NO_x$ emissions can be kept down to the 50–300 ppm range. $NO_x$ emissions decrease as excess $O_2$ in the flue gas is decreased. This is shown in FIG. 2, taken from FIG. 5 (N. Berge, $NO_x$ Control in a Circulating Fluidized Bed Combustor, CFB II, p. 426).

| | Typical Operating Conditions | |
|---|---|---|
| | Fixed ("bubbling") Fluid Bed Combustor | Circulating Fluid Bed Combustor |
| Temp, °F. | 1550 | 1650 |
| Pressure, psig | 2 | 3 |
| Superficial Velocity, ft/s | 3–12 | 15–25 |
| Entrainment lb/lb gms | 0.4–1 | 10–20 |
| gas residence time, sec | 0.5–1 | 3–4 |

Excess $O_2$ cannot be reduced below 2%, as at 1.5%, a sharp increase in CO occurs. This constraint is shown in FIG. 3, taken from FIG. 7 of the N. Berge publication.

Decreasing oxygen concentrations would decrease $NO_x$, but increase CO emissions. The best the unit could do would be to operate with enough air to achieve complete afterburning (20+% excess air!) and live with the $NO_x$ emissions.

I realized that it was possible to operate existing CFBs much more stably and efficiently, while producing less emissions and/or achieve high throughputs.

I realized that one of the main problems with CFB combustion units was that they operated with too much air. It was the general prejudice in the art that such operation was necessary to ensure complete CO combustion. Operators in general accepted the consequent relatively large emissions of $NO_x$ associated with such a highly oxidizing atmosphere. They also accepted the higher operating expense, and increased capital cost, associated with the oversized air blower, cyclone, and combustor inherent with these high air rates.

I was aware of the use that was made of CO combustion promoters in the FCC process. Typically 0.1–5 wt. ppm platinum was added to an FCC unit. This increased the temperature in the regenerator (to provide hotter catalyst for the FCC reaction). The amount of air added per pound of carbon burned increased, (to burn all of the carbon on the spent catalyst to $CO_2$, rather than a mixture of CO and $CO_2$).

I realized that by doing the opposite of what was done in the FCC process, that it would be possible to bring about significant changes in the CFB process. I wanted to add less air per weight of carbon burned, and have the option to operate at a lower temperature. I discovered a way to reduce the amount of air that was added, and even to reduce the CFB temperature, while actually improving the efficiency of the CFB unit and simultaneously minimizing $NO_x$ emissions.

BRIEF SUMMARY OF THE INVENTION

Accordingly, the present invention provides in a circulating fluidized bed combustion zone wherein a carbon-containing fuel is burned at an elevated temperature by contact with oxygen-containing gas added in an amount equal to at least 110% of the amount needed for complete combustion of the fuel, said combustion occuring in a generally vertical combustor comprising a fast fluidized bed or particulates wherein at least a majority of the particulate matter in the fast fluidized bed has a particle diameter in excess of 100 microns, to generate a flue gas/particulate stream which is discharged from the top of the combustor, said flue gas comprising excess oxygen, fines having a particle diameter less than about 100 microns, and circulating particles having an average particle size of about 100–400 microns, which flue gas passes through a separation means to recover from the flue, gas at least a majority of the 100–400 micron particles which are recycled to the circulating fluidized bed combustion zone, the improvement comprising burning said fuel in the presence of CO combustion promoter and reducing the amount of oxygen containing gas added per amount of fuel burned so that a total of 100 to 100% of the oxygen required for complete combustion of said fuel is added.

In another embodiment the present invention provides in a circulating fluidized bed combustion process for burning of a carbonaceous fuel comprising nitrogen and sulfur contaminants, wherein said combustion occurs in a combustion zone comprising fast fluidized bed in the presence of a circulating bed of solids comprising a sulfur acceptor material, and wherein the unit operates at a combustion zone temperature of 1550°–1650° F. with at least 15 percent excess air in the flue gas to ensure complete combustion of carbon monoxide, and said combustion zone temperature and excess air produce flue gas containing more than about 200 ppm vol. $NO_x$, the improvement comprising adding 0.001–100 wt. ppm of a CO combustion promoter selected from the group of Pt, Pd, Rh, Ir, Os, and mixtures and compounds thereof, reducing the amount of air added to within the range of 100–110 percent of stoichiometric, and decreasing the temperature of the CFB combustion zone by at least 100° F., without increasing the emissions of carbon monoxide via the flue gas, as compared to operation prior to addition of the CO combustion promoter.

DETAILED DESCRIPTION

Circulating Fluid Bed Combustors

This is a mature, commercial process, with about 100 units in operation or under construction as of 1988. A detailed description thereof is not believed necessary. Further details may be taken from Circulating Fluidized Bed Technology II, previously discussed, which is incorporated herein by reference. Additional details of circulating fluidized bed combustors may also be taken from the U.S. patents incorporated by reference in the background discussion.

Figure 1:
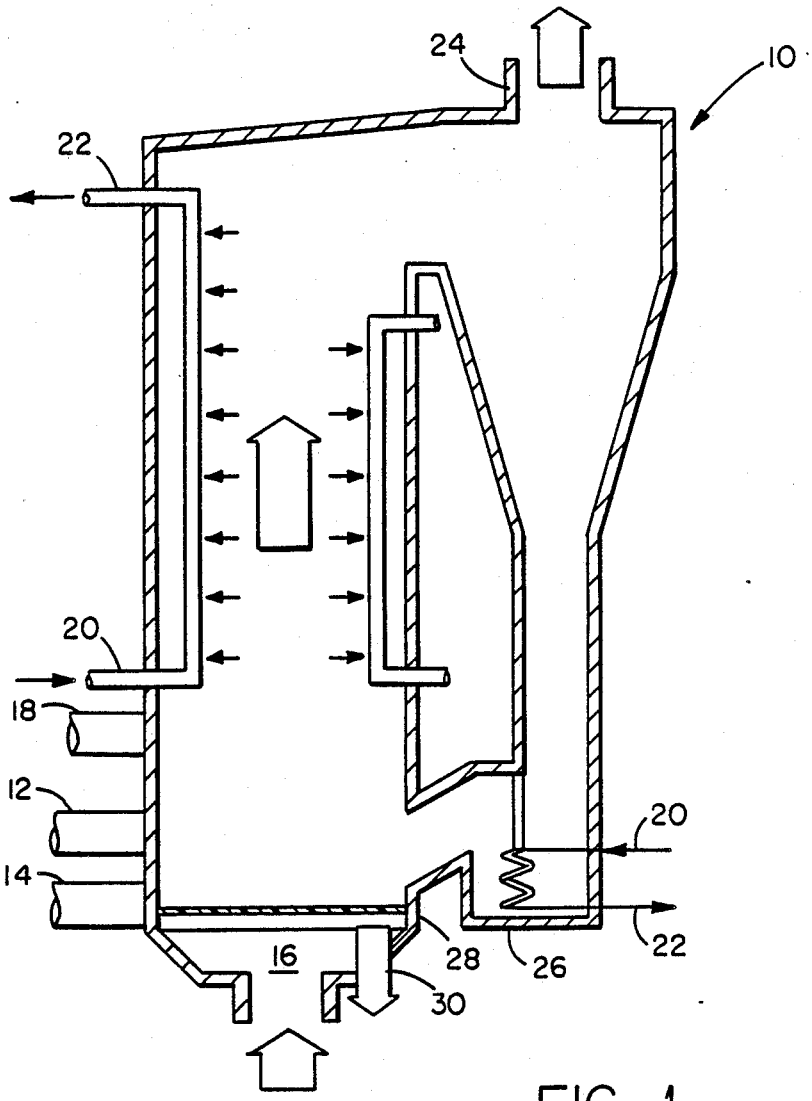
FIG. 1 (PRIOR ART)
FIG. 1 (Prior Art) is a simplified, schematic, cross-sectional view of a circulation fluid bed combustor.
Figure 2:
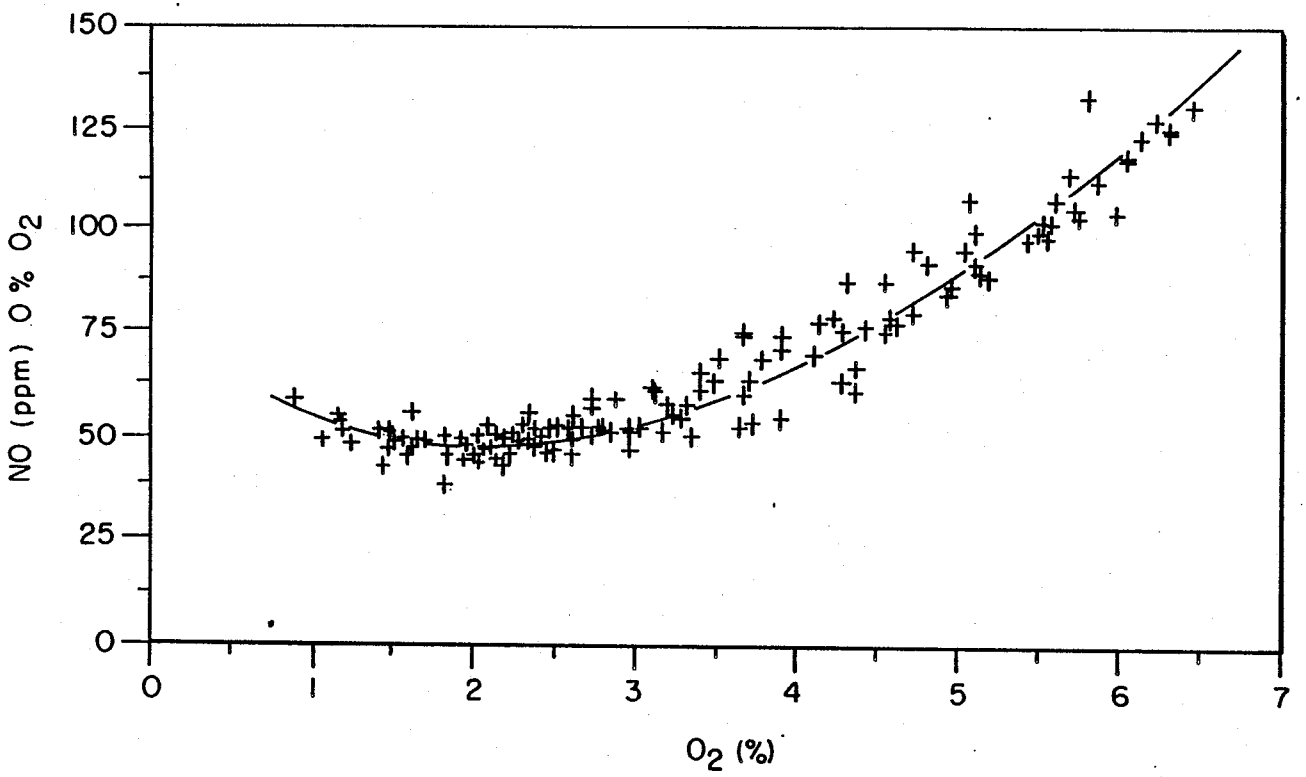
FIG. 2 illustrates how $NO_x$ emissions change with flue gas oxygen content in commercial CFB units.
Figure 3:
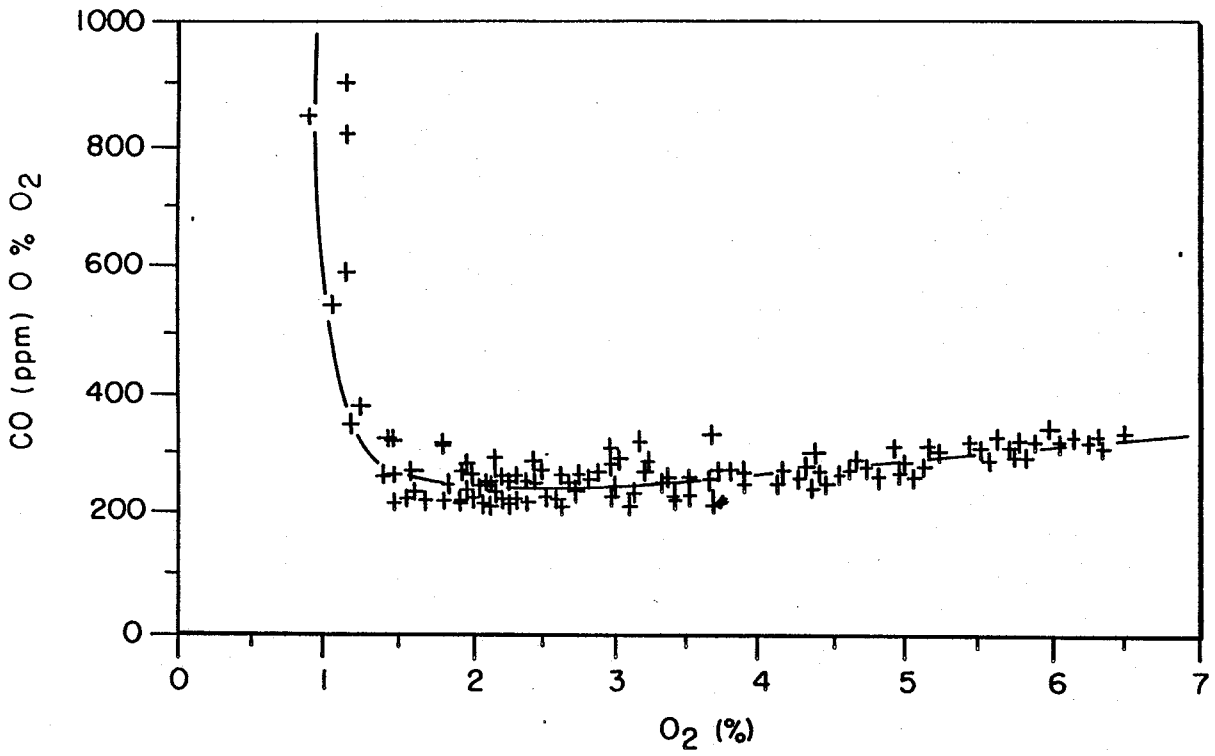
FIG. 3 shows how CO emissions change with flue gas $O_2$ content in commercial CFB units.

The typical circulating fluid-bed combustor illustrated in FIG. 1 shows a combustor 10 fed with a source of inert particles such as crushed limestone, through conduit 12 and fuel through conduit 14 together with a source of primary air through conduit 16 which ordinarily provides about 40–80% of the air required for combustion. A source of secondary air is fed through conduit 18 which provides the remaining 20–60% of the air necessary for combustion. Water circulating through heat exchangers 20, 20' is turned into steam when exiting conduits 22, 22' of heat exchangers 20, 20'. Gaseous products of combustion (flue gas) are removed through outlet 24 of combustor 10 with a recycle of the limestone and imcompletely burned fuel occurring in conduit 26. Ash may be removed through grate 28 and through conduit 30 to a site remote from combustor 10. The fuel fed through conduit 14 may include hazardous wastes and sludges which are otherwise expensive to dispose of. The combustor can also burn coal, low-value petroleum coke, or other refinery products. For example, in refineries limited by fuel gas production, excess fuel gas, such as FCC fuel gas, can be burned in the CFB combustor in combination with other fuels.

CO Combustion Promoters

Any kind of CO combustion promoter can be used, added in any manner. I prefer to use either a circulating CO combustion promoter or a fast settling CO combustion promoter or combination of both. Each of the preferred types of CO combustion promoter will be discussed.

Circulating CO Combustion Promoter

The CO combustion promoter contemplated is one which will readily circulate throughput the system, but will not be blow out with the fines. The promoter material should have an average particle size within the range of 80–400 microns, and preferably 100–300 microns, and most preferably 125–250 microns.

It is essential that the particles have physical properties which will allow them to be retained easily by the low efficiency cyclones associated with the CFB units. In most units this will mean that the terminal velocity of the promoter particles should be less than 15 feet per second, and preferably is about 4–12 feet per second.

Preferably, the CO combustion promoter is on a highly porous support. The support preferably has a porosity exceeding 50 percent. The particle density should be within the range of 1.4–2.4 g/cc, and preferably within the range of 1.5–2 g/cc. Many highly porous aluminas have particle densities of about 2 g/cc, and are ideal for use herein.

A majority, and preferably in excess of 90% of the CO combustion promoter is not on the outer surface of the promoter support. Conventional exchange/impregnation techniques will distribute the CO combustion promoter throughout the support particle.

The CO combustion promoter is preferably dispersed on a material having a relatively high surface area, e.g. a surface area in excess of 20, and preferably above 50, or even in excess of 500 meter sq./g, and preferably having a surface area of 75–250 m sq./g.

Alumina is an ideal support for the CO combustion promoter, because of its porosity, density, and high surface area. All of these physical properties are essential to keep the platinum in a highly dispersed state, where it can promote rapid afterburning of carbon monoxide to carbon dioxide. Silica/alumina, or silica, Kaolin or other similar catalyst supports can be used.

By way of contrast, sand is not a good support for the platinum CO combustion promoter contemplated herein. Sand is not a porous material. The Pt is all on the surface, and too readily clogged by ash and/or erosion or abrasion losses. Sand's density is also somewhat higher than preferred, typically around 2.5 g/cc.

The amount of CO combustion promoter required can vary greatly, depending on the efficiency of its use within the unit, the temperature at which the unit operates, and the amount of combustion promoter metal which is occluded or covered up by slag, fly ash, etc.

Operation with an amount of CO combustion promoter equivalent in activity to 0.001–100 ppm platinum, based on the total weight of solids circulating in the CFB, is preferred. Because of the high temperatures at which CFB units operate, it will be possible in many instances to operate with significantly less platinum, e.g., 0.01–10 wt. ppm platinum (or an equivalent amount of other CO combustion promoting metal, i.e., 3–5 wt. ppm $O_S$ is roughly equivalent to 1 wt. ppm Pt) may be used herein. In many units operation with 0.1–5 ppm platinum equivalents will give very good results.

Operation with much greater amounts of CO combustion promoter is possible, e.g., equivalent to 100–500 ppm Pt, but is usually not necessary and adds to the cost of the process, so such operation is not preferred.

Any CO combustion promoters now used fluidized catalytic cracking (FCC) units may be used herein. Pt, Pd, Ir, Rh, and Os may be used alone or in combinations. Some combinations, such as Pt/Rh, seem to reduce somewhat $NO_x$ emissions and may be preferred for use herein.

Although the same metals used to promote CO combustion in FCC units may be used in the process of the present invention, the conventional CO combustion promoter particles used in FCC are not suitable for use herein.

In typical FCC applications, the promoter material is present as platinum or some other CO combustion promoting metal, on a highly porous support, typically with an average particle size range of 40–80 microns. Typically the promoter contains 0.01, 0.1, or perhaps even 0.5 to 1 wt. % platinum. Typically the promoter contains 0.1 wt. % platinum.

If a drum of such CO combustion promoter were added to a CFB unit, all that would happen is that the promoter would be promptly swept out of the unit with the fly ash. The average particle size of the fly ash from most CFB units is about 75 microns. Some coals have 10–20 percent ash, so CFB units must efficiently remove particles below the size of the circulating dolomite, limestone, sand, etc., used to maintain a fluidized bed for heat exchange purposes. Ash is efficiently removed in CFB units by the use of low efficiency cyclones with exceedingly poor retention of particles less than 100–150 microns in diameter.

It will also be possible to create, in situ, in the CFB unit, promoter particles having the proper size. This will require addition of a soluble, readily decomposable CO combustion promoter metal precursor to the CFB unit. It will usually not be possible (as it is in FCC) to simply add some platinum compound to the feed. Adding chloroplatinic acid to the coal feed to the unit would lose most of the Pt to the fly ash produced by the rapid burning and disintegration of the coal. It is not preferred, for similar reasons, to add a CO combustion promoter solution to the combustion zone at the base of the fast fluidized bed where most of the combustion air is added. Again the promoter solution would be exposed too much to ash, and small particles of coal, and not enough of it would go on the circulating CO limestone, dolomite, sand, etc.

The preferred place for adding a platinum compound is to the regions of the CFB unit where natural elutriation has produced particles having the proper size. Several possibilities exist for this, namely injection of a CO combustion promoter metal solution into the upper, almost a dilute phase, region of the combustor, or into the cyclone dipleg, or into the dense bed heat exchanger region of the CFB.

Another alternative is to withdraw a slipstream of the circulating material, preferably at a location where the 100–300 micron size dolomite portion predominates, and impregnate or otherwise incorporate a CO combustion promoter into this slipstream of material and return the same to the circulating fluid bed.

Fast Settling Promoter Support

The CO combustion promoter should be on a catalyst support particle having a settling velocity well in excess of the 100–400 micron particles which comprise the bulk of the circulating material in a CFB unit. Ideally, the fast settling CO combustion promoters of the present invention will not circulate in the circulating fluid bed, but instead will "slip" so rapidly in the CFB combustor that they have an extremely long residence time relative to the 100–300 micron circulating material or even remain relatively stationary within the CFB bed. Much segregation in CFB combustors now occurs, i.e., at the lower region of the CFB unit are large particles of coal, wood chips, etc., large particles of lime, dolomite, etc. segregate. These large pieces remain in the lower portion of the bed due to their large size, weight and terminal velcity. These large particles may, to some extent, act as a fragmented support for the fast settling promoter.

By use of fast settling particles with a terminal velocity intermediate the terminal velocity of the large particles in the base of the fluidized bed, and the terminal velocity of the 100–400 micron particles of dolomite, clay, sand, etc., which circulate readily, it is possible to maintain at an intermediate portion of the CFB combustion zone the fast settling CO combustion promoter of the invention.

This has many advantages. The CO combustion promoter, at the 1300°–1700° F. temperatures contemplated for use herein, functions as an extremely efficient oxidation catalyst. Operation with as little as 0.001–100 ppm Pt equivalent CO combustion promoter metal will profoundly decrease CO emissions.

Because of the high settling velocity of the CO combustion promoter, very little of it will circulate through the CFB unit, and essentially none of it will be lost in the cyclones. Because the promoter tends to remain stationary, or for an extended period of time if not stationary, in the middle and upper regions of the CFB combustor zone, it will spend very little time in the lower regions where extremely high temperatures can be experienced due to localized burning. The "suspended" combustion promoter will be protected to some extent from fly ash deposition. In some CFB units, some of the ash content of the coal is removed as large agglomerates out the bottom of the CFB unit. Some units permit continuing removal of large ash agglomerates, while others remove ash intermittantly. Most of the fly ash is removed with the flue gas, even in units where ash agglomeration is a problem.

Another benefit to use of fast settling promoter is that the Pt, etc., is segregated where it is most needed, namely in the CO and $O_2$ rich regions just above the coke or coal burning zone in the combustor. CO combustion promoter does nothing useful in e.g., the cyclone dipleg.

It is believed that much of the ash agglomeration occurs during passage through the base of the combustor zone, so the life of the fast settling CO combustion promoter will be significantly extended due to its relatively permanent suspension above this combustion zone.

The CO combustion promoter may be disposed on particles having an average particle size of 200–6000 microns, and preferably on particles of 500–5000 microns average diameter, and most preferably, on 750–2500 micron sized particles.

For optimum results, the CO combustion promoter is sized so that it will tend to float above the relatively dense phase fluidized bed (where large particles of e.g., coal are burning) and remain for an extended period in the relatively dilute phase region which typically occupies the upper 50–90% of the volume of the combustor. Thus, the preferred size of the CO combustion promoter is 400–1200 microns, and more preferably 500–1000 microns, with the most preferred size being 550–750 microns.

Changes in CFB Operating Conditions

In accordance with the process of the present invention, the operation of the CFB unit is changed significantly. There are profound reductions in the amount of excess air supplied, which permit reductions in the operating temperature of the unit, and CO and/or $NO_x$ emissions.

Air Rates

Prior art CFB units operated with an average of 20 percent excess air, to ensure complete CO afterburning. It is now possible to operate with less than 10 percent excess air, and preferably less than 5 percent excess air. If the unit is well designed, and operation closely monitored, such as by an active control scheme wherein oxygen and/or CO content of the flue gas is used to set the amount of air added to the CFB combustor, it should be possible to operate with only 1 or 2 percent excess air while still ensuring essentially complete combustion of CO to $CO_2$.

Temperature

Essentially all prior art CFB units operated at a temperature of 1550°–1650° F. Such high temperatures were believed necessary for stable operation and for complete CO combustion. Such high temperatures also caused problems. The metallurgy becomes much more complex at higher temperatures than at lower temperatures. When coal is burned in a CFB unit, there is a significant ash agglomeration problem with many coals. Some ash melts or sinters and forms large particles which are difficult to accommodate in the CFB unit. $NO_x$ emissions increase with increases in temperature.

In my process, the CFB unit can operate stably at a much lower temperature, below 1500° F. and preferably within the range of 1350–1450. The lower temperature operation significantly reduces $NO_x$ emissions, but does not impair complete CO combustion. Lower temperature operation also makes the units much easier to design and, in many instances, keeps the ash particles of many coals below the sintering point. Ash containing coal will still release ash as fines or fly ash which can be removed as a dry powder, with fines, rather than allowed to form large aggregate particles which could impair smooth fluid circulation in the CFB. CFB combustor design can also be simplified if it does not have to provide a bottom draw off region for large particles of agglomerate.

$NO_x$ Emissions $NO_x$ emissions are reduced because of two effects. No longer is the unit flooded with 20%, 30% or even more excess air. This reduction in oxygen concentration brings about a marked reduction in $NO_x$ emissions. The second factor is the possibility of a profound reduction in temperature. No longer does most of the combustion occur at 1600° F., where nitrogen fixation readily occurs. Now much of the combustion may occur at temperatures about 100° F. lower than prior art CFB units.

Although temperatures can be maintained at high levels, as in prior art CFB units, I prefer to reduce temperatures by at least 100° F. to minimize $NO_x$ emissions.

It is also possible to adjust temperatures to maintain $NO_x$ emissions just below regulatory limits. This will permit maximum heat generation from a CFB.

Staged Air Injection

Staged air injection is a common way of minimizing $NO_x$ emissions. Usually a 50/50 split of primary and secondary air is used. In my process preferably one or more stages of air injection are supplied at various elevations within the CFB combustor. Staged air injection preferably provides 70–95% of the air required by stoichiometry in the densest region of the bed. The density of this region will vary somewhat from unit to unit, or in the same unit depending on throughput, material being burned, etc. In general terms, the highly expanded, fast fluidized bed of particulates has an average particle diameter in excess of about 200 microns. Typically this highly expanded bed will occupy from 10–40% of the vertical distance of the CFB combustor. Above this fast fluidized bed is a more dilute phase region.

Preferably enough secondary air is added immediately downstream of the fast fluidized, expanded bed region to increase the total amount of oxygen present to 100–110 percent of that required by stoichiometry for complete combustion of CO to $CO_2$.

Because of the excellent CO burning rates which can be achieved in the presence of the CO combustion promoter of the present invention, it is not necessary to operate with gross excesses of air such as has been done in the prior art.

Promoter Addition

The CO combustion promoter for use in the present invention can be added by any means. A fluidizable particulate CO combustion promoter can be added, the coal can be impregnated with platinum, a CO combustion promoter can be sprayed into any region of the combustor. These should not be considered equivalent means of adding the CO combustion promoter. For the practice of the present invention it is essential that some CO combustion promoter is present, but the method of adding it is not critical. Once through use of conventional FCC CO combustion promoter will work, but will cost a lot.

I prefer to add CO combustion promoter either as a 100–400 micron size particle, which is porous, has a high surface area, in excess of 20 $m^2/g$, and a relatively high density on the order of 1.5–2.5 g/cc. Such promoters circulate freely with the sulfur accepting material which makes up much of the inventory of the circulating fluidized bed.

In many installations it will be beneficial instead of, or in addition to, the above mode of CO combustion promoter addition, to put the promoter on elutriable particles which tend to float in an intermediate portion of the combustor.

Increased Throughput

Because the process of the present invention can be readily applied in many of the existing CFB units, it will be possible to do more with this technology than merely reduce $NO_x$ emissions and improve the efficiency of the operation by reducing the amount of excess air supplied.

It will also be possible to significantly increase the heat generation in a given combustor. If an operator chooses to obtain maximum throughput in a unit, it will be possible to increase the amount of coal, heavy fuel, etc. to the unit until all of the spare air blower capacity is utilized. In the case of a unit operating with 25 percent excess air, it will now be possible to increase throughputs on the order of 25 percent, without increasing air blower to stack gas capacity. The extra heat can be removed with external heat exchangers. Because of the more efficient CO combustion which occurs, it is now possible to carry a high inventory of circulating combustible material in the bed. Some coal can be burning even in the upper regions of the fluidized bed. Any CO which is formed from such coal combustion will be rapidly burned to $CO_2$ because of the presence of CO combustion promoter. Accordingly no longer will a majority of the coal, coke, or heavy fuel combustion be confined to the lower portion of the combustor, it will be possible to operate with multiple stages of fuel injection.

Increased Responsiveness

The CFB units of the present invention will also be significantly easier to start up or light up than conventional units. The CO combustion promoter helps get the unit rapidly through the initial start up period, when operation in conventional CFB units is unstable. Such prior art units, during start-up, are characterized by great swings in CO levels in stack gas. The CO combustion promoter contemplated for use herein will start eliminating or minimizing the CO content of the flue gas at very low temperatures, typically on the order of 1200–1300° F. This is in contrast to conventional CFB units which require much higher temperatures in order to achieve efficient CO afterburning.

EXAMPLE 1

Prior Art

The following example represents operating conditions in a circulating fluid bed boiler unit which was reported in the literature. The unit is a little unusual in that the feed was wood chips, rather than coal, so a sulfur capturing sorbent was not required to meet $SO_x$ emission limits. A solid particulate material was necessary for proper operation of the unit, so sand was added for heat transfer, proper bed fluidization, etc. Two CFB boiler designs are reported, a Babcock-Ultra Powered CFB boiler and an Energy Factors CFB boiler. Table 1, F. Belin, D. E. James, D. J. Walker, R. J. Warrick "Waste Wood Combustion in Circulating Fluidized Bed Boilers", reported in Circulating Fluidized Bed Technology, II at page 354.

TABLE I

Babcock & Wilcox CFB Boiler Performance Data

| | | Babcock-Ultrapower | | Energy Factors | |
|---|---|---|---|---|---|
| | Unit | Design | Test | Design | Test |
| Electric Load (Gross) | MW | 27.5 | 28.3 | 19.5 | 19.6 |
| Max Steam Flow | kg/s | 27.6 | 26.4 | 20.7 | 21.5 |
| (MCR) | 1000 lb/hr | 218.6 | 209.0 | 164.0 | 170.8 |
| Steam Pressure | bar | 86.2 | 85.9 | 87.5 | 87.2 |
| | psig | 1250 | 1245 | 1270 | 1265 |
| Steam | °C. | 513 | 511 | 513 | 509 |
| Temperature | °F. | 955 | 951 | 955 | 949 |
| Feedwater | °C. | 147 | 151 | 186 | 196 |
| Temperature | °F. | 296 | 303 | 367 | 385 |
| Gas/Air | °C. | 857 | 873 | 849 | 823 |
| Temperatures | °F. | 1575 | 1603 | 1560 | 1514 |
| Furnace Exit Gas | | | | | |
| Flue Gas Leaving | °C. | 135 | 128 | 150 | 152 |
| Air Heater | °F. | 275 | 263 | 302 | 305 |
| Air Leaving Air | °C. | 209 | 203 | 191 | 189 |
| Heater | °F. | 408 | 398 | 375 | 372 |
| Thermal Efficiency (HHV Basis) | % | 78.8 | 79.81 | 81.3 | 81.28 |
| Fuel Moisture | % | 40.0 | 38.0 | 30.0 | 46.4 |
| Unburned Carbon Loss | % | 1.2 | .01 | 1.2 | 0.09 |
| Excess Air | % | 16 | 24 | 21 | 19 |
| Primary/Overfire Air Split | % | 50/50 | 50/50 | 60/40 | 25/75 |
| Emissions at MCR | | Limits: | | Limits: | |
| $NO_x$ | lb/$10^6$Btu | 0.158 | .155 | .175 | 0.110 |
| CO | lb/$10^6$Btu | 0.158 | .025 | .218 | 0.100 |

Illustrative Embodiment (Invention)

In this example I have estimated the changes that would occur due to the addition of 1 ppm platinum to the circulating solids inventory in the Babcock-Ultrapower unit. I would add the platinum as a Pt on silica/alumina support having a particle density of about 2.0 g/cc and an average particle size of about 150 microns. The promoter would be similar to that used in conventional FCC catalyst, but quite a bit larger than catalyst used in FCC units, and somewhat heavier. Conventional spray drying is the preferred method of making the catalyst. The promoter would contain 0.1 wt. % platinum, so addition of 1 wt. % additive to the circulating inventory in the CFB would give 1 ppm platinum.

By operating with CO combustion promoter, and less than 10% excess air, there will be a profound reduction in CO emissions and a reduction in $NO_x$ emissions. Although this a beneficial result, it does not represent the best use of this technology.

I would prefer to reduce excess air, and/or increase fuel addition rate, up to the limit of the units heat exchanger capacity.

In designing a new unit, I would design and make the combustion zone, cyclones, and air blower smaller because of the reduction in air rates permitted by the invention. Operating with only 2% excess air, instead of 20% excess air would reduce the volume of the CFB unit by more than 10%, and reduce the capital cost by close to 10%, and reduce energy consumption in the CFB by over 10%.

Use of a freely circulating CO combustion promoter would allow coke (or other fuel) combustion much higher up in the bed, without formation of excess $CO_2$ in the flue gas. The unit can thus burn much more feed, and generate more heat.

Circulating CO combustion promoter will not change the mechanical operation of the CFB. The heavy, relatively large fluidizable particles will be retained very well by the cyclones associated with the CFB unit.

Using the process of the present invention, it is now possible to reduce the sum of the $NO_x$ and CO emissions to less than 200 ppm, and even below 100 ppm. If desired, it is believed possible, by staged air injection, and reduced temperature operation with relatively large amounts of CO combustion promoter, to operate the unit with an order of magnitude less $NO_x$ and CO emissions than could be achieved in prior art CFBs. It is now possible to essentially eliminate CO emissions and reduce $NO_x$ emissions below 50 ppm.

What is claimed:

1. In a circulating fluidized bed combustion zone wherein a carbon-containing fuel is burned at an elevated temperature by contact with oxygen-containing gas added in an amount equal to at least 110% of the amount needed for complete combustion of the fuel, said combustion occurring in a generally vertical combustor comprising a fast fluidized bed of patriculated including limestone or dolomite wherein at least a majority of the particulate matter in the fast fluidized bed has a particle diameter in excess of 100 microns, to generate a flue gas/particulate stream which is discharged from the top of the combustor, said flue gas comprising excess oxygen, fines having a particle diameter less than about 100 microns, and circulating particles having average particle size of about 100–400 microns, which flue gas passes through a separation means to recover from the flue gas at least a majority of the 100–400 micron particles which are recycled to the circulating fluidized bed combustion zone, the improvement comprising burning said fuel in the presence of about 0.001 to 100 wt. ppm CO combustion promoter selected from the group of Pt, Pd, Rh, Ir, OS, and mixtures and compounds thereof in the combustion zone and reducing the amount of oxygen containing gas added per amount of fuel burned so that a total of 100 to 110% of the oxygen required for complete combustion of said fuel is added.

2. The process of claim 1 further characterized in that the temperature in the combustion zone is decreased by at least 100° F.

3. The process of claim 1 further characterized in that the oxygen containing gas is present in an amount equal to 100–105 percent of stoichiometric.

4. The process of claim further characterized in that 0.01–10 ppm platinum is present.

5. The process of claim 1 further characterized in that the CO combustion promoter circulates and is present as particles of 100–400 microns in diameter.

6. The process of claim 1 further characterized in that the CO combustion promoter is present on particles of 400–1200 microns diameter.

7. The process of claim 1 further characterized in that the oxygen-containing gas is air, and the air is added in at least two stages to the combustor.

8. The process of claim 1 further characterized in that the temperature and excess oxygen are reduced to the combined total of $NO_x$ and CO emissions, expressed as ppm, to less than 100.

9. In a circulating fluidized bed combustion process for burning of a carbonaceous fuel comprising nitrogen and sulfur contaminants, wherein said combustion occurs in a combustion zone comprising fast fluidized bed in the presence of a circulating bed of limestone or dolomite operates at a combustion zone temperature of 1550°–1650° F. with at least 15 percent excess air in the flue gas to ensure complete combustion of carbon monoxide, and said combustion zone temperature and excess air produce flue gas containing more than about 200 ppm vol. $NO_x$, the improvement comprising adding 0.001–100 wt. ppm of a CO combustion promoter selected from the group of Pt, Pd, Rh, Ir, Os, and mixtures and compounds thereof, reducing the amount of air added to within the range of 100–110 percent of stoichiometric, and decreasing the temperature of the combustion zone by at least 100° F., without increasing the emissions of carbon monoxide via the flue gas, as compared to operation prior to addition of the CO combustion promoter.

10. The process of claim 9 further characterized in that the oxygen containing gas is present in an amount equal to 100–105 percent of stoichiometric.

11. The process of claim 9 further characterized in that 0.01–10 ppm platinum is present.

12. The process of claim 9 further characterized in that the CO combustion promoter circulates and is present as particles of 100–400 microns in diameter.

13. The process of claim 9 further characterized in that the CO combustion promoter is present on particles of 400–1200 microns diameter.

14. The process of claim 9 further characterized in that the oxygen-containing gas is air, and the air is added in at least two stages to the combustor.

15. The process of claim 9 further characterized in that the temperature and excess oxygen are reduced to the combined total of $NO_x$ and CO emissions, expressed as ppm, to less than 100.

* * * * *

UNITED STATES PATENT AND TRADEMARK OFFICE

CERTIFICATE OF CORRECTION

PATENT NO. : 4,927,348

DATED : May 22, 1990

INVENTOR(S) : Amos A. Avidan

It is certified that error appears in the above-identified patent and that said Letters Patent is hereby corrected as shown below:

| Patent Column | Patent Line # | Errors made in Patent | Corrections to be Made in Patent |
|---|---|---|---|
| 13 | 23 | "particulated" | particulates, |
| 13 | 51 | "process of claim" | process of claim 1 |
| 14 | 18 | "circulating bed of" limestone or dolomite". | circulating bed of solids comprising a sulfur acceptor comprising limestone or dolomite, and wherein the unit |

Signed and Sealed this

Tenth Day of March, 1992

*Attest:*

*Attesting Officer*

HARRY F. MANBECK, JR.

*Commissioner of Patents and Trademarks*